US005574547A

United States Patent [19]

Denton et al.

[11] Patent Number: 5,574,547

[45] Date of Patent: Nov. 12, 1996

[54] LIQUID ELECTROPHOTOGRAPHIC REPRODUCTION MACHINE EMPLOYING HEATED CARRIER LIQUID

[75] Inventors: Gary A. Denton, Webster; John F. Knapp, Fairport; James R. Larson, Fairport; Damodar M. Pai, Fairport, all of N.Y.

[73] Assignee: Xerox Corporation, Stamford, Conn.

[21] Appl. No.: 473,808

[22] Filed: Jun. 7, 1995

[51] Int. Cl.[6] ..... G03G 15/10

[52] U.S. Cl. ..... 399/251; 347/100

[58] Field of Search ..... 355/245, 256, 355/257, 258; 118/659, 660, 661, 662; 346/140.1; 347/84, 95, 100

[56] References Cited

U.S. PATENT DOCUMENTS

| | | | |
|---|---|---|---|
| 4,024,834 | 5/1977 | Carter | 355/245 X |
| 4,566,781 | 1/1986 | Kuehnle | 355/256 |
| 4,686,936 | 8/1987 | Chow | 118/661 |
| 4,782,347 | 11/1988 | Kurematsu et al. | 346/140.1 |
| 4,965,609 | 10/1990 | Tomida et al. | 347/100 |
| 5,028,964 | 7/1991 | Landa et al. | 355/273 |
| 5,424,813 | 6/1995 | Schlueter, Jr. et al. | 355/256 |

*Primary Examiner*—Sandra L. Brase
*Attorney, Agent, or Firm*—Tallam I. Nguti

[57] ABSTRACT

In accordance with the present invention, there is provided in a liquid electrophotographic reproduction machine, a development unit for developing latent images on an image bearing member using liquid developer material. The development unit includes a housing defining a liquid developer material holding chamber, and a quantity of liquid developer material contained within the chamber. The quantity of developer material includes carrier liquid and charged toner particles dispersed within the quantity of carrier liquid. The development unit also includes a heating element located inside the quantity of developer material for heating the quantity of developer material. The quantity of developer material when heated has a desired elevated temperature within a range of 50 to 60 degrees centigrade for improved developability without causing toner particle agglomeration.

10 Claims, 2 Drawing Sheets

LIQUID ELECTROPHOTOGRAPHIC REPRODUCTION MACHINE EMPLOYING HEATED CARRIER LIQUID

BACKGROUND OF THE INVENTION

This invention relates to electrostatographic reproduction machines, and more particularly to a liquid electrophotographic reproduction machine using elevated temperature heated carrier liquid for improved developability.

Liquid electrophotographic reproduction machines are well known, and generally each include a development system that utilizes a liquid developer material typically having about 2 percent by weight of fine solid particulate toner material dispersed in a liquid carrier. The liquid carrier is typically a hydrocarbon. In the electrophotographic process of such a machine, a latent image formed on an image bearing member or photoreceptor is developed with the liquid developer material. The developed image on the photoreceptor typically contains about 12 percent by weight of particulate toner in liquid hydrocarbon carrier. To improve the quality of transfer of the developed image to a receiver, the image is conditioned so as to increase the percent solids of the liquid developer forming the image to about 25 percent. Such conditioning is achieved by removing excess hydrocarbon liquid from the developed liquid image. However, such removal must be carried out in a manner that results in minimum degradation of the toner particles forming the liquid image. The conditioned image is then subsequently transferred to a receiver which may be an intermediate transfer belt and then to a recording or copy sheet for fusing to form a hard copy.

Liquid electrophotographic reproduction machines as such can produce single color images or multicolor images on such a recording or copy sheet. The quality or acceptability of a color copy produced as such is ordinarily a function on how the human eye and mind receives and perceives the colors of the original and compares it to the colors of the copy. The human eye has three color receptors that sense red light, green light, and blue light. These colors are known as the three primary colors of light. These colors can be reproduced by one of two methods, additive color mixing and subtractive color mixing, depending on the way the colored object emits or reflects light.

In the method of additive color mixing, light of the three primary colors is projected onto a white screen and mixed together to create various colors. A well known exemplary device that uses the additive color method is the color television. In the subtractive color method, colors are created from the three colors yellow, magenta and cyan, that are complementary to the three primary colors. The method involves progressively subtracting light from white light. Examples of subtractive color mixing are color photography and color reproduction. Also, it has been found that electrophotographic reproduction machines are capable of building up a full subtractive color image from cyan, magenta, yellow and black. They can produce a subtractive color image by one of three methods.

One method is to transfer the developed image of each color on an intermediary, such as a belt or drum, then transferring all the images superimposed on each other on a sheet of copy paper.

A second method involves developing and transferring an image onto a sheet of copy paper, then superimposing a second and subsequent images onto the same sheet of copy paper. Typically an image processing system using this method can produce a first color image by developing that color image on a photoconductive surface, transferring the image onto a sheet of copy paper, and then similarly and sequentially producing and superimposing a second, and subsequent images onto the same sheet of copy paper.

A third method utilizes what is referred to as a Recharge, Expose, and Develop or REaD process. In this process, the light reflected from the original is first converted into an electrical signal by a raster input scanner (RIS), subjected to image processing, then reconverted into a light, pixel by pixel, by a raster output scanner (ROS) which exposes the charged photoconductive surface to record a latent image thereon corresponding to the substractive color of one of the colors of the appropriately colored toner particles at a first development station. The photoconductive surface with the developed image thereon is recharged and re-exposed to record the latent image thereon corresponding to the subtractive primary of another color of the original. This latent image is developed with appropriately colored toner. This process (READ) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original.

Liquid developers when utilized in machines making single color (black and white) images or multicolor images according to any of the above methods, have many advantages over dry developer materials or toners. For example, liquid developers often result in images of higher quality than images formed with dry toners. Liquid toner particles can usually be made relatively very small without resulting in problems often associated with small particle powder toners, problems such as machine dirt which can adversely affect process reliability. Development with liquid developers in full color imaging processes also has many advantages, such as a texturally attractive print because there is substantially no height buildup, whereas full color images developed with dry toners often exhibit height build-up of the image where color areas overlap. Further, full color prints made with liquid developers can be made to a uniformly glossy or a uniformly matte finish, whereas uniformity of finish is difficult to achieve with powder toners because of variations in the toner pile height, the need for thermal fusion, and the like.

In Liquid electrophotographic reproduction machines as disclosed for example in U.S. Pat. No. 5,028,964 the conventional practice and strategy are for running the development process of each such machine at near room temperature, and for heating the developed images preferably on the intermediate transfer member, after initial transfer to such intermediate member. As such, the intermediate member, such as a belt, must thereafter be actively cooled before the next image is transferred to it from the photoreceptor.

In such machines, it is also desirable to use low vapor pressure carrier liquids, such as mineral oils, in which to disperse toner particles. Unfortunately however, this desire ordinarily when achieved, is offset by a penalty of relatively higher carrier liquid viscosity, and hence a penalty of reduced toner mobility within the carrier liquid. Furthermore, use of such mineral oil-based inks or liquid toners may require the use of relatively larger or additional rollers in the development subsystem. The use of such rollers would understandably increase significantly the cost and size of the development subsystem, and may even require larger photoreceptor belts, and hence larger and more costly machines overall.

There is therefore a need for a liquid electrophotographic reproduction machine which uses a very low vapor pressure mineral oil for the carrier fluid, and yields improved developability without significant increased cost.

SUMMARY OF THE INVENTION

In accordance with the present invention, there is provided in a liquid electrophotographic reproduction machine, a development unit for developing latent images on an image bearing member using liquid developer material. The development unit includes a housing defining a liquid developer material holding chamber, and a quantity of liquid developer material contained within the chamber. The quantity of developer material includes carrier liquid and charged toner particles dispersed within the carrier liquid. The development unit also includes a heating element located inside the quantity of developer material for heating the quantity of developer material. The quantity of developer material when heated has a desired elevated temperature within a range of 50 to 60 degrees centigrade for improved developability without causing toner particle agglomeration.

DESCRIPTION OF THE DRAWINGS

Other aspects of the present invention will become apparent as the following description proceeds and upon reference to the drawings, in which.

DETAILED DESCRIPTION OF THE INVENTION

Figure 1:
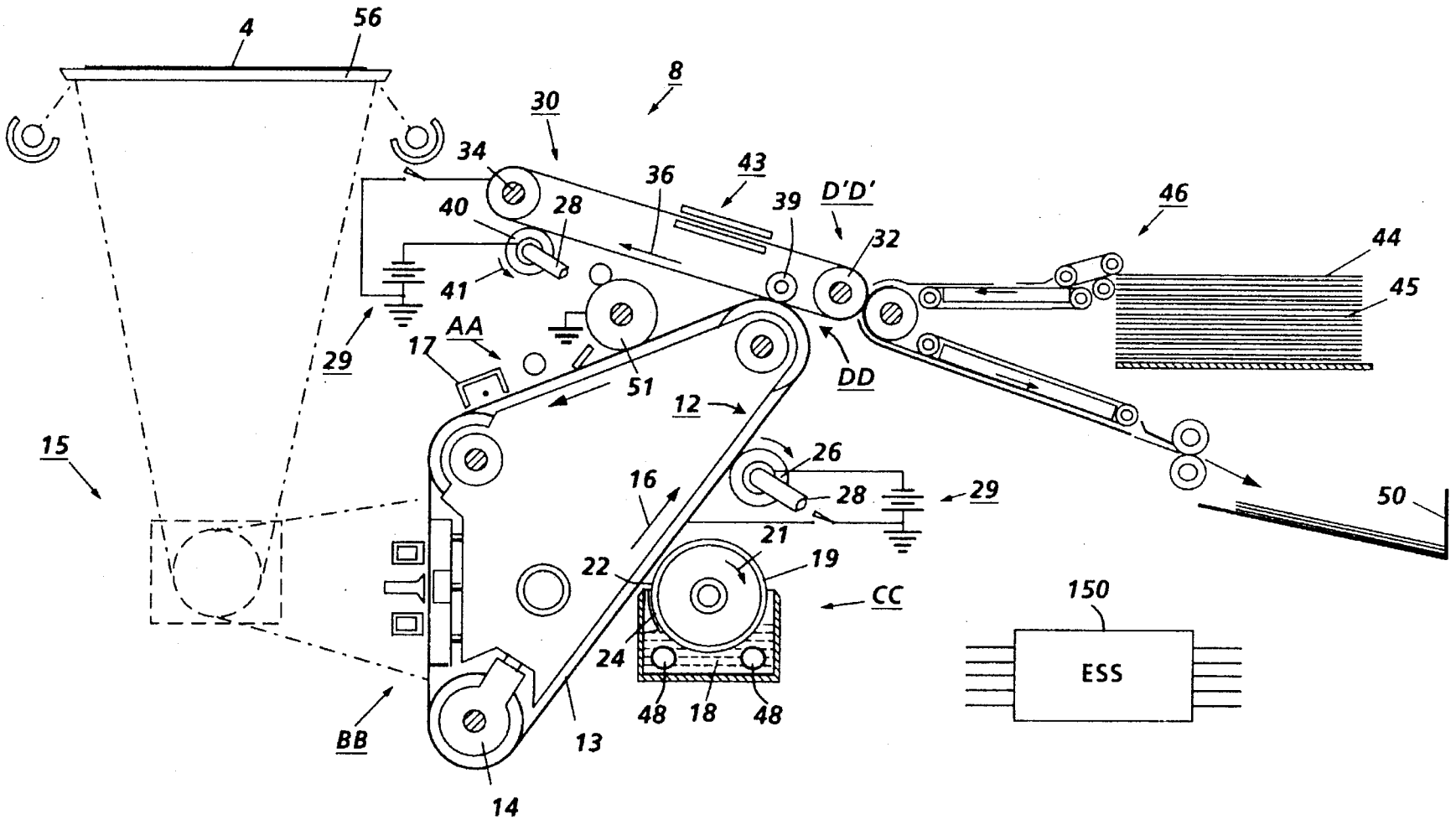
FIG. 1 is a schematic, elevational view of a single color black and white electrophotographic liquid toner reproduction machine incorporating the development unit and carrier liquid heating element of the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 reproduction machines will be shown hereinafter only schematically, and their operation described only briefly.

Referring to FIG. 1, there is shown a reproduction machine 8 employing a belt 12 including a photoconductive surface 13 deposited on a conductive substrate. A roller 14 rotates and advances belt 12 in the direction of arrow 16. Belt 12 passes through charging station AA where a corona generating device 17 charges the photoconductive surface 13 of the belt 12 a portion at a time to a high and generally uniform potential. The charged portions of belt 12 are advanced sequentially to an exposure station BB where image rays from an original document 4 on a transparent platen 56 are projected by means of an optical system 15 onto the charged portion of the photoconductive surface so as to record an electrostatic latent image. Alternatively as is well known, a raster output scanner (ROS) device (not shown) can be used to write a latent image bitmap from digital electronic data by selectively erasing charges in areas of a charged portion on the charged belt 12. Such a ROS device writes the image data pixel by pixel in a line screen registration mode. In either case, it should be noted that the latent image can be thus formed for a discharged area development (DAD) process machine in which discharged areas are developed with toner, or for a charged area development (CAD) process machine in which the charged areas are developed with toner.

After the electrostatic latent image has been recorded thus, belt 12 advances to development station CC where a liquid developer material 18 including liquid carrier and charged toner particles from a chamber of a development apparatus 20 is advanced through a development zone or nip 22. At development station CC, a developer roller 19 rotating in the direction of arrow 21 advances liquid developer material 18 through the nip 22. An electrode 24 positioned before an entrance into development nip 22 is electrically biased so as to disperse the toner particles as solids in a substantially uniformly manner throughout the liquid carrier.

More importantly according to the present invention (to be described in detail below) the development apparatus 20 includes heating elements 48 for desirably heating the liquid developer material 18 to an elevated temperature within a range of 50 to 60 degrees centigrade, preferably a temperature of 55 degrees centigrade in order to reduce viscosity of the liquid developer material and to improve its developability.

Development station CC also includes a porous blotter roller 26 having perforations through the skin surface thereof. Roller 26 is mounted so as to contact the liquid toner developed image on belt 12, and so as to condition the liquid image by reducing its fluid content (thereby increasing its percent solids) while at the same time inhibiting the departure of toner particles from the image. The roller 26 operates in conjunction with a vacuum device 28 for removing the liquid carrier from the liquid toner image. A bias voltage 29 is applied to roller 18 so that a repelling force is present to prevent toner particles from leaving the photoconductive surface and entering the roller 26.

After the electrostatic latent image is developed, belt 12 advances the developed image to transfer station DD where the developed liquid image is electrostatically transferred from belt 12 to an intermediate member or belt 30. As shown, belt 30 is entrained about rollers 32 and 34, and is moved in the direction of arrow 36. A bias transfer roller 39 urges intermediate transfer belt 30 against image bearing belt 12 in order to assure effective transfer of the conditioned liquid toner image from belt 12 to the intermediate belt 30. A second porous blotter roller 40, having perforations through the roller skin covering, also then contacts the transferred image on belt 30 to further reduce its fluid content (increasing its percent solids) while preventing toner particles from departing from the image. The roller 40 by further removing excess liquid carrier as such increases the percent solids to between 25 and 75.% by weight, for example.

Increasing the percent solids of the transferred liquid toner image on the intermediate belt 30 is a particularly important function in a liquid color image developing process that utilizes multiple superimposed images of different colors.

In operation, roller 40 rotates in the direction of arrow 41 to impinge against the liquid toner image image on belt 30. The porous body of roller 40 absorbs liquid from the surface of the transferred image. The absorbed liquid permeates through roller 40 and into an inner hollow cavity thereof, where the vacuum device 28 draws such liquid out of the roller 40 and into a liquid receptacle for subsequent disposal or recirculation as liquid carrier. Porous roller 40 then continues to rotate in the direction of arrow 41 to ensure continuous absorption of excess liquid from liquid toner images on transfer belt 30. A bias voltage 29 is applied to the roller 40 to establish a repelling electrostatic field against charged toner particles forming the images, thereby preventing such toner particles from transferring to the roller 40.

Belt 30 then advances the transferred image through a heating device 43 to a second transfer station D'D' where a sheet of support material 44 is advanced from stack 45 of such sheets by a sheet transport mechanism 46. The transferred image from the photoconductive surface of belt 30 is then attracted or transferred to copy sheet 44. After such transfer a, conveyor belt 46 moves the copy sheet 44 to a discharge output tray 50. As shown, after toner image transfer at transfer station DD, a cleaning device 51 including a roller formed of suitable material is driven into scrubbing engagement with the surface 13 of belt 12 in order to clean the surface 13.

Figure 2:
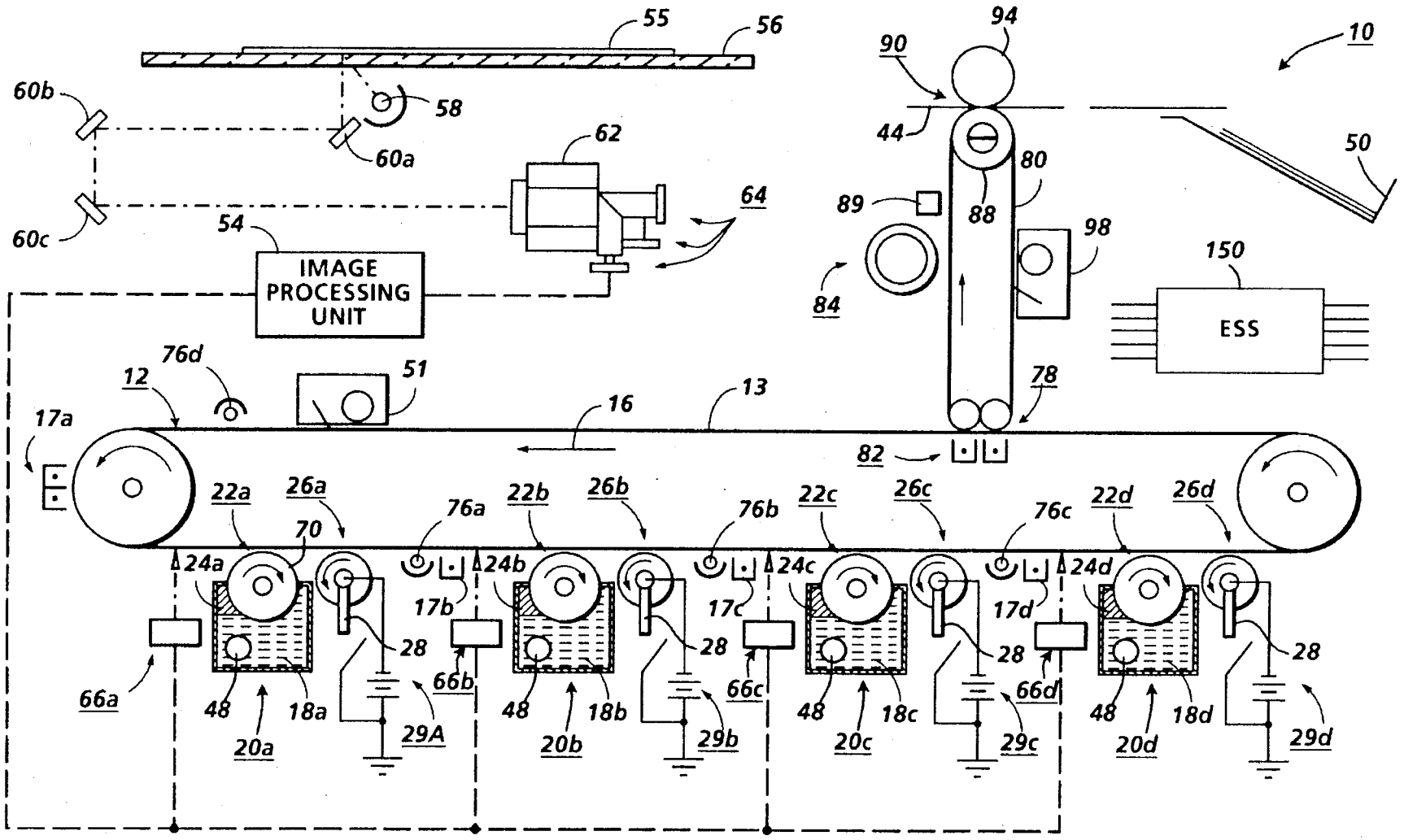
FIG. 2 is a color electrophotographic liquid toner reproduction machine incorporating the development unit and carrier liquid heating element of the present invention.

Turning now to FIG. 2, there is shown a color electrophotographic reproduction machine 10 incorporating the carrier liquid heating element of the present invention. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals a re converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive surface 13, and, in some embodiments, an anticurl backing layer. As shown, belt 12 is movable in the direction of arrow 16. The moving belt 12 is first charged by a charging unit 17*a*. A raster output scanner (ROS) device 66*a*, controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

After the electrostatic latent image has been recorded thus, belt 12 advances the electrostatic latent image to development station 20*a*. At development station 20*a*, a development roller 70, rotating in the direction as shown, advances a liquid developer material 18*a*, preferably black toner developer material, from the chamber of a development housing to a development zone or nip 22*a*. An electrode 24*a* positioned before the entrance to development zone or nip 22*a* is electrically biased to generate an AC field just prior to the entrance to development zone or nip 22*a* so as to disperse the toner particles substantially uniformly throughout the liquid carrier. The toner particles, disseminated through the liquid carrier, pass by electrophoresis to the electrostatic latent image. As is well known, the charge of the toner particles is opposite in polarity to the charge on the photoconductive surface 13.

Liquid developer materials suitable for the color machine 10 generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles can be any colored particle compatible with the liquid medium or carrier. For example, the toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. The toner particles may be present in amounts of from about 1 to about 10, and preferably from about 2 to about 4 percent by weight of the developer composition.

Examples of suitable charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

In accordance with the present invention, each of the development units 20*a*, 20*b*, 20*c*, and 20*d* includes a heating element 48 for heating the carrier liquid and hence the liquid developer material to a desirable elevated temperature. Preferably, the developer material is heated as such to a temperature near 50 degrees C where the viscosity of the carrier liquid is significantly reduced, and the developability is improved without causing toner agglomeration. The elevated temperature operates to reduce the environmental range that the liquid developer material 18, and the photoreceptor belt 12 must operate in. The elevated temperature also assists the step of image conditioning (toner compaction/fluid removal) for example by the roller 26*a*, 26*b*, 26*c*, and 26*d*. In addition, the temperature difference between the temperature of a toner image at development and that at a transfix step is thus reduced by the higher development temperature, thus making transfixing easier and reducing heat management problems within the machine.

According to the present invention, the developer material 18 preferably includes a carrier liquid that is a low vapor pressure mineral oil. In addition, it also preferably includes toner particles that are formulated, for example, from a polymer resin. The liquid developer material temperature preferably should be maintained within a range of 50–60 degrees C. by the heat elements 48 within the sump or chamber of each development unit. This would reduce the liquid viscosity by about 40% and thereby improve the developability of the developer materials. Preferably, the heating element 48 consists of a heat conductive conduit and a quantity of a heatable fluid contained in the conduit. The heatable fluid can for example be water or even the same as the carrier liquid of the developer material 18. Alternatively the element 48 is a direct heating element made for example of stainless steel in order to prevent its reaction with, or contamination of, the liquid developer material.

After the first liquid color separation image is developed, for example with black liquid toner, it is conditioned by a conditioning porous roller 26*a*, 26*b*, 26*c*, 26*d* having perforations through the roller skin covering. Roller 26*a* contacts the developed image on belt 12 and conditions the image by compacting the toner particles of the image and reducing the fluid content thereof (thus increasing the percent solids) while inhibiting the departure of toner particles from the image. Preferably, the percent solids in the developed image is increased to more than 20 percent by weight. Porous roller 26*a*, 26*b*, 26*c*, 26*d* operates in conjunction with a vacuum 28 which removes liquid from the roller. A pressure roller (not shown), mounted in pressure contact against the blotter roller 26*a*, may be used in conjunction with or in the place of the vacuum device 28, to squeeze the absorbed liquid carrier from the blotter roller for deposit into a receptacle.

In operation, roller 26*a*, 26*b*, 26*c*, 26*d* rotates in direction as shown to impose against the "wet" image on belt 12. The porous body of roller 26*a*, 26*b*, 26*c*, 26*d* absorbs excess liquid from the surface of the image through the skin covering pores and perforations. Vacuum device 28 located on one end of a central cavity of the roller 26*a*, 26*b*, 26*c*, 26*d*, draws liquid that has permeated into the roller, out through the cavity. Vacuum device 28 deposits the liquid in a receptacle or some other location for either disposal or recirculation as liquid carrier. Porous roller 26*a*, 26*b*, 26*c*, 26*d* then, continues to rotate in the direction as shown to provide a continuous absorption of liquid from the image on belt 12. The image on belt 12 advances to lamp 76*a* where any residual charge left on the photoconductive surface 13 of belt 12 is erased by flooding the photoconductive surface with light from lamp 76*a*.

As shown, according to the REaD process of the machine 10, the developed latent image on belt 12 is subsequently recharged with charging unit 17*b*, and is next re-exposed by ROS 66*b*. ROS 66*b* superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration. At development station 20*b*, a development roller 70, rotating in the direction as shown, advances a liquid developer material 18*b* from the chamber of development housing to development a zone or nip 22*b*. An electrode 24*b* positioned before the entrance to development zone or nip 22*b* is electrically biased to generate an AC field just prior to the entrance to development zone or nip 22*b* so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image.

A second conditioning roller 26*b* receives the developed image on belt 12 and conditions the image by reducing fluid content while inhibiting the departure of toner particles from the image, and by compacting the toner particles of the image. Preferably, the percent solids is more than 20 percent, however, the percent of solids can range between 15 percent and 40 percent. The images on belt 12 advances to lamp 76*b* where any residual charge left on the photoconductive surface is erased by flooding the photoconductive surface with light from lamp 76.

To similarly produce the third image using the third toner color, for example magenta color toner, the developed images on moving belt 12 are recharged with charging unit 17*c*, and re-exposed by a ROS 66*c*. ROS 66*c* superimposing a third color image bitmap information over the previous developed latent image. At development station 20*c*, development roller 70, rotating in the direction as shown, advances a magenta liquid developer material 18*c* from the chamber of development housing to a development zone or nip 22*c*. An electrode 24*c* positioned before the entrance to development zone or nip 22*c* is electrically biased to generate an AC field just prior to the entrance to development zone or nip 22*c* so as to disperse the toner particles substantially uniformly throughout the liquid carrier. The toner particles, disseminated through the liquid carrier, pass by electrophoresis to the previous developed image. A conditioning roller 26*c* receives the developed images on belt 12 and conditions the images by reducing fluid content so that the images have a percent solid s within a range between 15 percent and 40 percent. The images or composite image on belt 12 advances to lamp 76*c* where any residual charge left on the photoconductive surface of belt 12 is erased by flooding the photoconductive surface with light from the lamp.

Finally, to similarly produce the fourth image using the fourth toner color, for example cyan color toner, the developed images on moving belt 12 are recharged with charging unit 17*d*, and re-exposed by a ROS 66*d*. ROS 66*d* superimposing a fourth color image bitmap information over the previous developed latent images. At development station 20*d*, development roller 70, rotating in the direction as shown, advances a cyan liquid developer material 18*d* from the chamber of development housing to a development zone or nip 22*d*. An electrode 24*d* positioned before the entrance to development zone or nip 22*d* is electrically biased to generate an AC field just prior to the entrance to development zone or nip 22*d* so as to disperse the toner particles substantially uniformly throughout the liquid carrier. The toner particles, disseminated through the liquid carrier, pass by electrophoresis to the previous developed image. A conditioning roller 26*d* receives the developed images on belt 12 and conditions the images by reducing fluid content so that the images have a percent solids within a range between 15 percent and 40 percent.

The resultant composite multicolor image, a multi layer image by virtue of different color toner development by the developing stations 20*a*, 20*b*, 20*c* and 20*d*, respectively having black, yellow, magenta, and cyan, toners, is then advanced to an intermediate transfer station 78. It should be evident to one skilled in the art that the color of toner at each development station could be in a different arrangement.

At the transfer station 78, the resultant multicolor liquid image is subsequently electrostatically transferred to an intermediate member 80 with the aid of a charging device 82. Intermediate member 80 may be either a rigid roll or an endless belt, as shown, having a path defined by a plurality of rollers in contact with the inner surface thereof. It is preferred that intermediate member 80 comprise at least a two layer structure in which the substrate layer has a thickness greater than 0.1 mm and a resistivity of $10^6$ ohm-cm. An insulating top layer has a thickness less than 10 micron, a dielectric constant of 10, and a resistivity of $10^{13}$ ohm-cm. The top layer also has an adhesive release surface. Also, it is preferred that both layers each have a matching hardness less than 60 durometer. Preferably, both layers are composed of Viton™ (a fluoroelastomer of vinylidene fluoride and hexafluoropropylene) which can be laminated together.

The multicolor image on the intermediate transfer member 80 is conditioned again for example by a blotter roller 84 which reduces the fluid content of the transferred image by compacting the toner particles of the image while inhibiting the departure of toner particles from the image. Blotter roller 84 is adapted to condition the image so that it has a toner composition of more than 50 percent solids.

Subsequently, multicolor image on the surface of the intermediate member 80 is advanced through a liquefaction stage before being transferred within a second transfer nip 90 to an image recording sheet 44. Within the liquefaction stage, particles of toner forming the transferred image are transformed by a heat source 88 into a tackified or molten state. The heat source 88 can applied to member 80 internally. Preferably, the tackified toner particle image is then transferred, and bonded, to recording sheet 44 with limited wicking by the sheet. More specifically, the liquefaction stage also includes an external heating element 89 which heats the external surface of the intermediate member 80 within a transfix nip 90 to a temperature sufficient to cause the toner particles present on such surface to melt. The toner particles on the surface, while softening and coalescing due to the application of such heat, ordinarily maintain the position in which they were deposited on the outer surface of member 80, thereby not altering the image pattern which they represent.

The intermediate member 80 then continues to advance in the direction of arrow 92 until the tackified toner particles reach the nip 90. Nip 90 is more specifically a transfixing nip, where the multicolor image is not only transferred to the recording sheet 44, but it is also fused or fixed by the application of appropriate heat and pressure. At transfix nip 90, the liquefied toner particles are forced, by a normal force applied through a backup pressure roll 94, into contact with the surface of recording sheet 44. Moreover, recording sheet 44 may have a previously transferred toner image present on a surface thereof as the result of a prior imaging operation, i.e. duplexing. The normal force, produces a nip pressure which is preferably about 20 psi, and may also be applied to the recording sheet via a resilient blade or similar spring-like member uniformly biased against the outer surface of the intermediate member across its width.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet. Furthermore, the transfixed image becomes permanent once allowed to cool below their melting temperature. As shown, the surface of the intermediate transfer belt 80 is thereafter cleaned by a cleaning device 98 prior to receiving another toner image from the belt 12.

Invariably, after the multicolor image was transferred from the belt 12 to intermediate member 80, residual liquid developer material remained adhering to the photoconductive surface of belt 12. A cleaning device 51 including a roller formed of any appropriate synthetic resin, is therefore driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp 76*d* prior to again charging the belt 12 for producing another multicolor image as above.

In accordance with the advantages of the present invention, the increased operating temperature of each development unit could actually reduce the overall cost of the machine 8, 10 (FIGS. 1 and 2), for example, by reducing the amount of heat that has to be pumped into and out of the intermediate belt 30,80. For instance, the heater 43, 89 associated with the high solids image conditioning station may no longer be required, or may be reduced in cost and size. Experimental data on the liquid developer materials showed that no significant degradation is expected at temperatures below 55 degrees C.

Ordinarily, the use of mineral oils as the dispersant, requires that the developer material sump or chamber be heated only up to 35 degrees C. in order to decrease the liquid viscosity into a working range (6–7 cp). Concern over the stability of developer materials at elevated temperatures caused the determination of the impact of high temperatures on developer material functional properties. Tests reveal that to the extent of the measurement capability, developer materials were acceptably stable up to 60 degrees C. The developer material was subjected to the elevated temperature for a period of time ranging from 4 hours to four days. They were then cooled, and a sample take and heated up to the next higher temperature level within the preferred range. The results of this test showed that the only permanent change in the developer material was at temperatures in excess of 60 degrees C. where the particle size was seen to increase, thus causing a decrease in the particle mobility. The rate of the change in the particle size was determined by subjecting a sample to 65 degrees C. and monitoring the particle size change over a period of 24 hours. The volume average did not change in any distinguishable pattern over this time, but the number distribution showed that the population of very fine particles (less than 1 micron) did decrease from about 80% to 50% over the first few hours, and then stabilized at about 45%.

Additionally, it has been found that photoreceptors can be used effectively at elevated temperatures within the preferred range. There appear to be no fundamental limitations (in fact, the current or electrical life of some types of photoreceptors is actually enhanced as a result of warm machine cavity temperatures, approaching 50 degrees C.). Hydrogenated amorphous silicon photoreceptors for example, are currently being operated safely at 40 degrees C.

Referring to FIGS. 1 and 2, the machine 8, 10 for example includes an electronic subsystem (ESS) 150 as are well known for controlling the various aspects and operating components of the machine, including the operation of the heating elements 48 in each of the development units 20, 20*a*, 20*b*, 20*c*, and 20*d*.

It is, therefore, evident that there has been provided, in accordance with the present invention, a development unit in a black and white or in a full color, high speed reproduction machine that includes a heating element for heating liquid developer to a desirable elevated temperature for improving developability. While this invention has been described in conjunction with one embodiment thereof, it is evident that many alternatives, modifications and variations will be apparent to those skilled in the art. Accordingly, it is intended to embrace all such alternatives, modification and variations as fall within the spirit and broad scope of the appended claims.

We claim:

1. A liquid electrophotographic reproduction machine comprising:

(a) an image bearing member movable along a process path;

(b) latent image forming means mounted along the process path for forming a latent image electrostatically on said image bearing member; and (c) a development unit mounted along the process path for developing the latent image using liquid developer material, said development unit having a housing defining a developer material holding chamber, and said chamber including a heating element for heating liquid developer material within said chamber to a desired elevated temperature so as to reduce viscosity of the liquid developer material and improve developability, said heating element comprising a heat conductive conduit and a quantity of a heatable fluid contained in said conduit.

2. The reproduction machine of claim 1, wherein said chamber includes a plurality of said heating elements.

3. The reproduction machine of claim 1, wherein said chamber includes a heating element for heating liquid developer material within said chamber to an elevated temperature within a range of 50 to 60 degrees centigrade.

4. The reproduction machine of claim 3, wherein said chamber includes a heating element for heating liquid developer material within said chamber to an elevated temperature of 55 degrees centigrade.

5. The reproduction machine of claim 1, wherein said heatable fluid comprises water.

6. The reproduction machine of claim 1, wherein said heatable fluid comprises a quantity of carrier liquid for liquid developer material usable within said chamber.

7. In a liquid electrophotographic reproduction machine, a development unit for developing latent images on an image bearing member using liquid developer material, the development unit comprising:

(a) a housing defining a liquid developer material holding chamber;

(b) a quantity of liquid developer material contained within said chamber, said quantity of developer material including carrier liquid and charged toner particles dispersed within said quantity of carrier liquid; and (c) a heating element located inside said quantity of developer material for heating said quantity of developer material, said heating element comprising a heat conductive fluid and a quantity of a heatable fluid contained in said conduit, and said quantity of developer material when heated-having a desired elevated temperature for improved developability without causing toner particle agglomeration.

8. The development unit of claim 7 wherein said carrier liquid comprises a mineral oil having a relatively low vapor pressure.

9. The development unit of claim 7 wherein said quantity of developer material within said chamber when heated has a desired elevated temperature within a range of 50 to 60 degrees centigrade.

10. The development unit of claim 7 wherein said quantity of developer material within said chamber when heated has a desired elevated temperature of 55 degrees centigrade.

* * * * *